US010137584B2

(12) United States Patent
Lee et al.

(10) Patent No.: US 10,137,584 B2
(45) Date of Patent: Nov. 27, 2018

(54) ADAPTER FOR A HANDLE AND A CARTRIDGE OF DIFFERENT RAZOR SYSTEMS

(71) Applicant: The Gillette Company, Boston, MA (US)

(72) Inventors: Alejandro Carlos Lee, Cambridge, MA (US); Vincent Paul Walker, Bridgewater, MA (US)

(73) Assignee: The Gillette Company LLC, Boston, MA (US)

( * ) Notice: Subject to any disclaimer, the term of this patent is extended or adjusted under 35 U.S.C. 154(b) by 23 days.

(21) Appl. No.: 15/169,624

(22) Filed: May 31, 2016

(65) Prior Publication Data

US 2017/0341248 A1 Nov. 30, 2017

(51) Int. Cl.

| | |
|---|---|
| ***B26B 21/14*** | (2006.01) |
| ***B26B 21/52*** | (2006.01) |
| ***B26B 21/22*** | (2006.01) |
| ***B26B 21/40*** | (2006.01) |

(52) U.S. Cl.

CPC ..... *B26B 21/521* (2013.01); *B26B 21/14* (2013.01); *B26B 21/225* (2013.01); *B26B 21/40* (2013.01)

(58) Field of Classification Search

CPC ..... B26B 21/521; B26B 21/14
USPC ..... 30/50, 526–533
See application file for complete search history.

(56) References Cited

U.S. PATENT DOCUMENTS

| | | | | |
|---|---|---|---|---|
| 4,253,237 | A * | 3/1981 | Jacobson | B26B 21/521 30/530 |
| 4,413,411 | A * | 11/1983 | Trotta | B26B 21/521 30/526 |
| 4,422,237 | A * | 12/1983 | Trotta | B26B 21/521 30/526 |
| 5,107,590 | A * | 4/1992 | Burout, III | B25G 1/10 30/47 |
| 5,157,834 | A * | 10/1992 | Chen | B26B 21/225 30/47 |
| 5,182,858 | A * | 2/1993 | Chen | B26B 21/521 30/49 |
| 6,418,623 | B1 * | 7/2002 | Marcarelli | B26B 21/22 30/34.1 |
| 6,581,290 | B1 * | 6/2003 | Fishel | B26B 21/222 132/289 |
| 7,197,825 | B2 * | 4/2007 | Walker | B26B 21/225 30/34.2 |
| 7,200,942 | B2 * | 4/2007 | Richard | B26B 21/225 30/526 |
| 7,681,320 | B2 * | 3/2010 | Szczepanowski | B26B 21/225 30/34.05 |
| 7,690,122 | B2 * | 4/2010 | Worrick, III | B26B 21/222 30/50 |
| 8,033,023 | B2 * | 10/2011 | Johnson | B26B 21/225 30/50 |
| 8,205,344 | B2 * | 6/2012 | Stevens | B26B 21/521 30/526 |
| 8,590,162 | B2 * | 11/2013 | Park | B26B 21/225 30/50 |

(Continued)

*Primary Examiner* — Sean Michalski
(74) *Attorney, Agent, or Firm* — Joanne N. Pappas; Kevin C. Johnson

(57) ABSTRACT

An adapter for coupling each of a razor handle and a razor cartridge together is provided. The adapter includes a cartridge engaging portion and a handle engaging portion.

40 Claims, 15 Drawing Sheets

(56) References Cited

U.S. PATENT DOCUMENTS

| | | | | |
|---|---|---|---|---|
| 8,671,577 | B2 * | 3/2014 | Brown | B26B 21/521 30/50 |
| 8,745,876 | B2 * | 6/2014 | Hage | B26B 21/10 30/34.1 |
| 8,789,282 | B2 * | 7/2014 | Wilson | B26B 21/521 30/32 |
| 8,793,880 | B2 * | 8/2014 | Taub | B26B 21/521 30/32 |
| 9,764,487 | B2 * | 9/2017 | Robertson | B26B 21/521 |
| 2008/0034589 | A1 * | 2/2008 | Nearing | B26B 21/222 30/32 |
| 2009/0288299 | A1 * | 11/2009 | Denkert | B26B 21/225 30/50 |

* cited by examiner

ADAPTER FOR A HANDLE AND A CARTRIDGE OF DIFFERENT RAZOR SYSTEMS

FIELD OF INVENTION

The systems described below generally relate to an adaptor for different razor systems. More particularly, the adapter allows for a razor handle of one type of docking interface to be coupled with a cartridge of a different type of docking interface.

BACKGROUND OF INVENTION

The shaving razor category has many different razor configurations, including razors that are "system" razors which have long lasting handles with replaceable cartridges, and disposable razors where the handle and cartridge are used together and the cartridge is thrown out after a time. Razors vary based on many attributes such as number of blades, cartridge shape, chemistry features on the cartridge and so forth. Razors are also manufactured by many different companies with different technology platforms.

Many system razors have their own docking interface between the handle and cartridge. The use of different docking systems is known. For example, MACH3® and many GILLETTE VENUS® razor systems leverage a single point docking system. The GILLETTE SENSOR® and SENSOR® for Women razors have a different docking system with two attachment features that provide the dual function of attaching the cartridge and providing the arc about which the cartridge can pivot. These and other docking systems have been described. See U.S. Pat. Nos. 5,813,293; 5,787,586; 5,918,369; 4,739,553; and 4,756,082, U.S. Design Pat. No. D714,492; and U.S. Patent Application Pub. No. 2011/0067245.

Many reasons exist for why new docking interfaces exist, such as upgrades to technology, ease of attaching/removing the cartridge, and so forth. Some razors even include fixedly attached structures on the razors that attach to the handle. These structures are sometimes referred to as the interconnect feature. See U.S. Pat. Nos. 7,168,173, 7,703,361, and 8,033,023. These interconnect structures, however, are provided with each and every cartridge in a fixed arrangement, and disposed of with the cartridge after use. For example, U.S. Pat. No. 7,703,361, which is similar to the GILLETTE VENUS BREEZE® razor, the cartridge includes the interconnect feature which is not designed for removal from the cartridge housing. The opposing retaining features are attached to receiving regions in the back of the cartridge housing and absent a considerable amount of force, they cannot easily be detached.

Recently the use of adapters has been discussed to allow FUSION® type razors to attach with MACH3® type replaceable cartridges. See U.S. Pat. No. 8,793,880. Despite these advances, there remains a need to provide users with even more flexibility when they select replacement cartridges for their existing system handles.

SUMMARY OF INVENTION

In accordance with one embodiment, an adapter for coupling each of a razor handle and a razor cartridge together is provided. The adapter comprises a handle engaging portion and a cartridge engaging portion. The handle engaging portion comprises at least one wall, a first handle protrusion, and a second handle protrusion. The at least one wall defines a receptacle for receiving a razor handle. The first handle protrusion extends from the at least one wall. The second handle protrusion extends from the at least one wall and is spaced from the first handle protrusion. The first handle protrusion and the second handle protrusion are configured to extend into a first recess and a second recess, respectively, of a stem of a razor handle. The cartridge engaging portion is coupled with the handle engaging portion. The cartridge engaging portion comprises a stem and a collar. The stem defines a recess for selectively engaging a cartridge protrusion. The collar is slidably coupled with the stem and is slidable between a resting position and an ejecting position. Sliding the collar from the resting position to the ejecting position facilitates ejection of a cartridge from the stem.

In accordance with another embodiment, an adapter for coupling each of a razor handle and a razor cartridge together is provided. The adapter comprises a handle engaging portion and a cartridge engaging portion. The handle engaging portion comprises at least one first wall, a first handle protrusion, and a second handle protrusion. The at least one first wall defines a first receptacle for receiving a razor handle. The first handle protrusion extends from the at least one first wall. The second handle protrusion extends from the at least one first wall and is spaced from the first handle protrusion. The first handle protrusion and the second handle protrusion are configured to extend into a first recess and a second recess, respectively, of a stem of a razor handle. The cartridge engaging portion is coupled with the handle engaging portion. The cartridge engaging portion comprises at least one second wall and a button assembly. The at least one second wall defines a second receptacle. The button assembly is movably coupled with the at least one second wall and is movable between a resting position and an ejecting position. Moving the button assembly from the resting position to the ejecting position facilitates ejection of a cartridge from the cartridge engaging portion.

In accordance with yet another embodiment, an adapter for coupling each of a razor handle and a razor cartridge together is provided. The adapter comprises a handle engaging portion and a cartridge engaging portion. The handle engaging portion comprises at least one first wall, a first handle protrusion, and a second handle protrusion. The at least one first wall defines a first receptacle for receiving a razor handle. The first handle protrusion extends from the at least one first wall. The second handle protrusion extends from the at least one first wall and is spaced from the first handle protrusion. The first handle protrusion and the second handle protrusion are configured to extend into a first recess and a second recess, respectively, of a stem of a razor handle. The cartridge engaging portion is coupled with the handle engaging portion. The cartridge engaging portion comprises a first stem and a second stem. The first stem defines a first recess for selectively engaging a first cartridge protrusion. The second stem defines a second recess for selectively engaging a second cartridge protrusion.

In accordance with still yet another embodiment, an adapter for coupling each of a razor handle and a razor cartridge together is provided. The adapter comprises a handle engaging portion, a cartridge engaging portion, and a pair of resilient members that facilitate pivotal coupling of the cartridge engaging portion with the handle engaging portion. The handle engaging portion comprises at least one first wall, a first handle protrusion, and a second handle protrusion. The at least one first wall defines a first receptacle for receiving a razor handle. The first handle protrusion extends from the at least one first wall. The second handle protrusion extends from the at least one first wall and is spaced from the first handle protrusion. The first handle protrusion and the second handle protrusion are configured to extend into a first recess and a second recess, respectively, of a stem of a razor handle.

BRIEF DESCRIPTION OF THE DRAWINGS

It is believed that certain embodiments will be better understood from the following description taken in conjunction with the accompanying drawings in which.

DETAILED DESCRIPTION OF THE INVENTION

Figure 1:
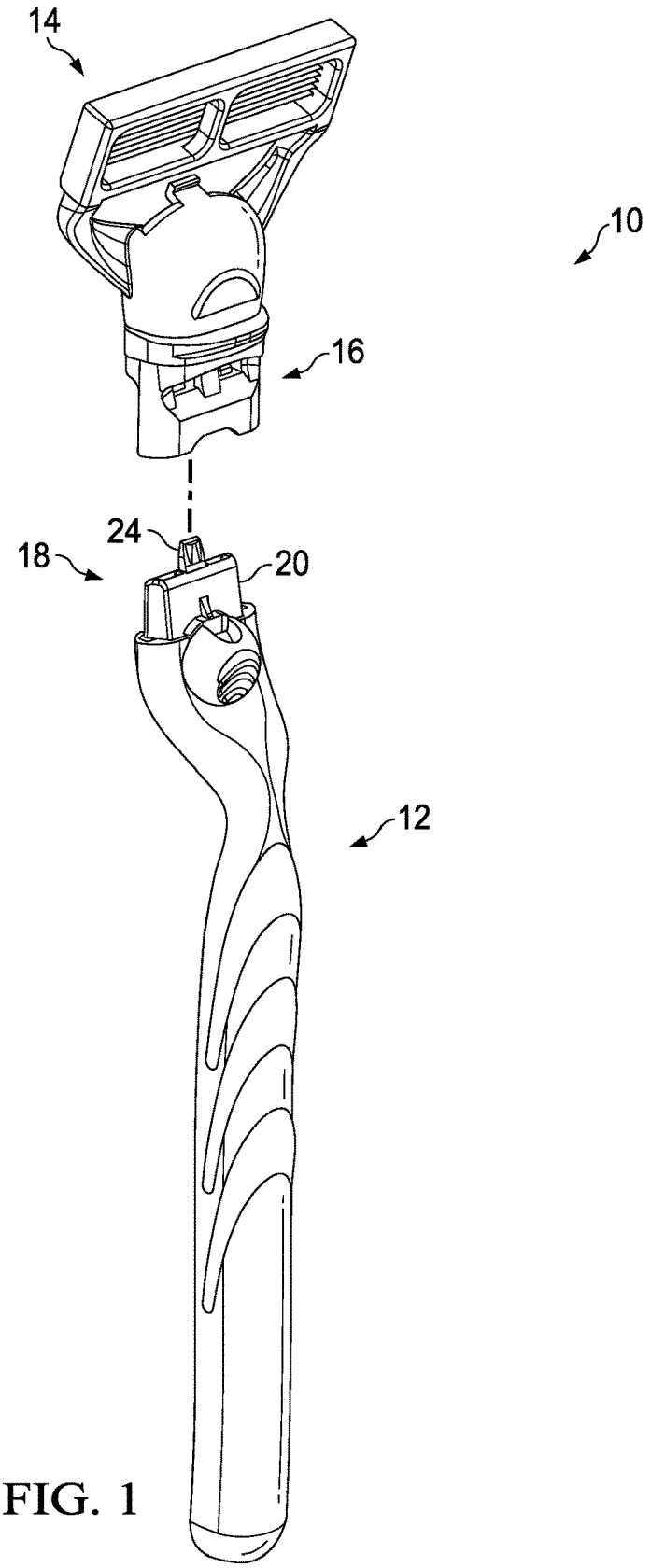
FIG. 1 is an exploded isometric view depicting a razor system having a handle, a cartridge, and an adapter in accordance with one embodiment.
Figure 2:
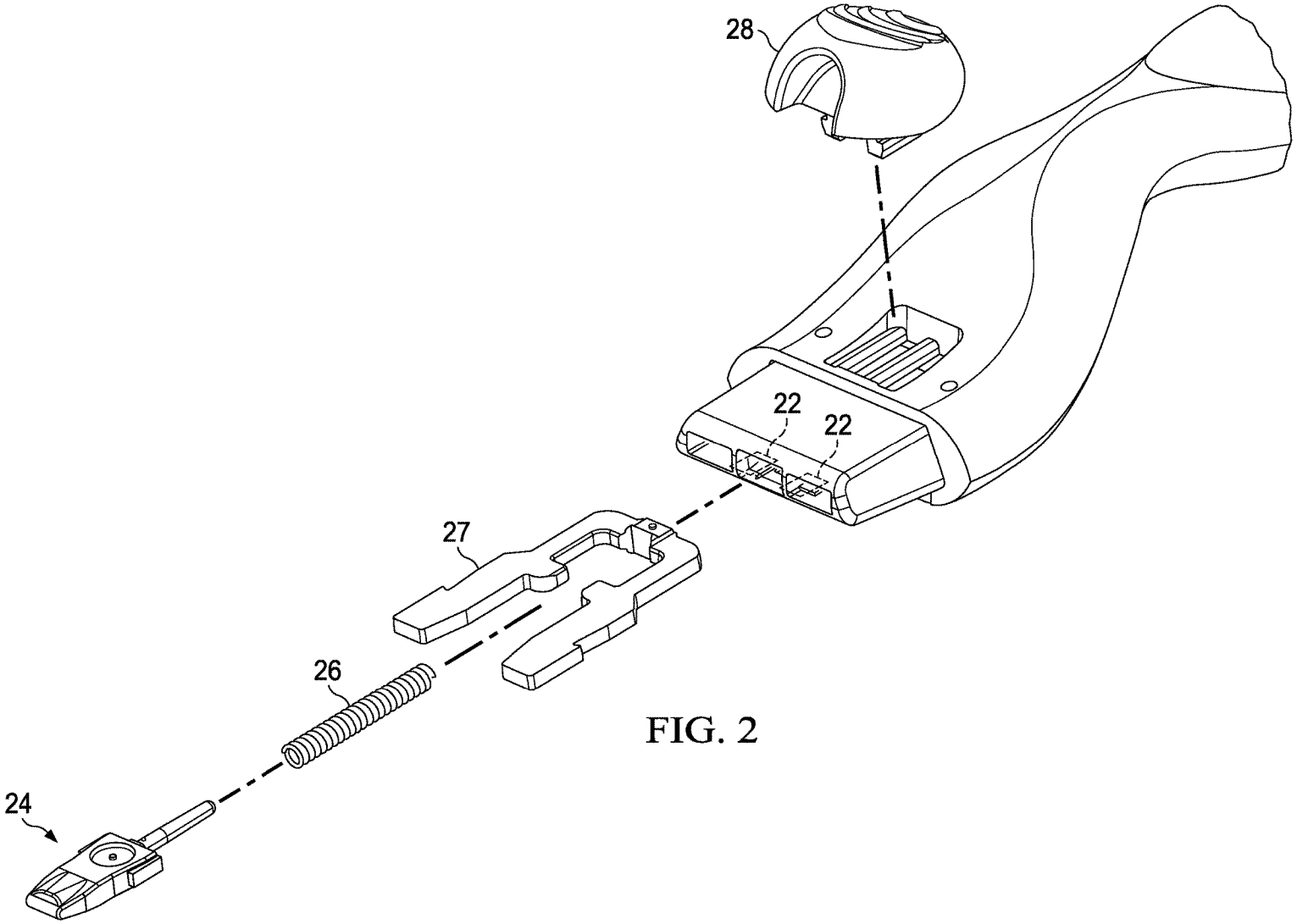
FIG. 2 is an exploded isometric view depicting a portion of the handle of FIG. 1.

In connection with the views and examples of FIGS. 1-18, wherein like numbers indicate the same or corresponding elements throughout the views, a razor system 10 is shown in FIG. 1 to include a handle 12, a cartridge 14, and an adapter 16. The handle 12 and the cartridge 14 can have different docking interfaces, and the adapter 16 can be configured to facilitate coupling of the handle 12 to the cartridge 14. As illustrated in FIGS. 1 and 2, the handle 12 can be provided with a GILLETTE MACH3® docking interface. The handle 12 can comprise a stem 18 having an upper surface 20 and a lower surface (not shown). The lower surface can define a pair of recesses 22 (shown in dashed lines) that are configured to interact with corresponding protrusions on a compatible cartridge (i.e., a MACH3® cartridge) to facilitate retention of the compatible cartridge thereto.

A tongue member 24 can extend through the stem 18 and can be slidable with respect to the stem 18 between an extended position (shown in FIG. 1) and a retracted position (not shown). As illustrated in FIG. 2, the handle 12 can include a spring 26 that biases the tongue member 24 into the extended position which can facilitate forward pivoting of an attached compatible cartridge. The handle 12 can also include a push member 27 that is slidably coupled with the stem 18 and slidable between a retracted position and an extended position. The spring 26 can bias the push member 27 into the retracted position. A button 28 can engage the push member 27 and can be slid (e.g., by a user's finger) to move the push member 27 to the extended position which can cause it to protrude from the stem 18 thereby facilitating ejection of an attached compatible cartridge. In one embodiment, the push member 27 can be substantially U-shaped.

Figure 3:
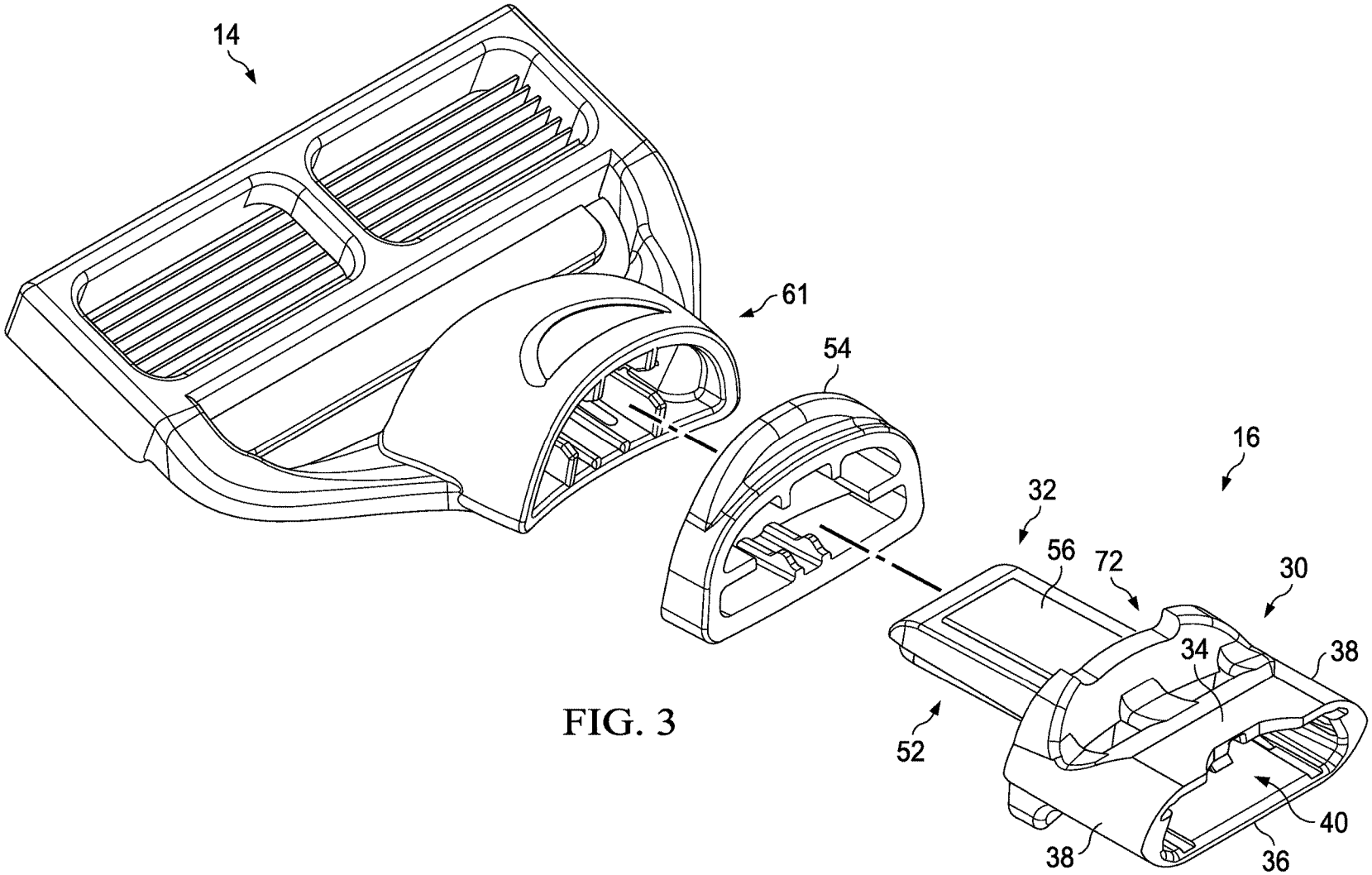
FIG. 3 is an exploded isometric view depicting the handle, the cartridge, and the adapter of FIG. 1, in accordance with one embodiment.

Referring now to FIG. 3, the cartridge 14 can have a docking interface for a HARRY'S° razor handle which is different from the GILLETTE MACH3® docking interface of the handle 12. As such, the cartridge 14 is unable to be mounted directly onto the handle 12. The adapter 16 can include a handle engaging portion 30 and a cartridge engaging portion 32 that are coupled together and are each configured to facilitate coupling of the handle 12 and the cartridge 14 together. In one embodiment, the handle and cartridge engaging portions 30, 32 can be formed together as a unitary one-piece construction. In another embodiment, the handle and cartridge engaging portions 30, 32 can be formed as separate components and mechanically coupled together. Each of the handle and cartridge engaging portions 30, 32 are configured to be compatible with the handle 12 and the cartridge 14, respectively.

Figure 4:
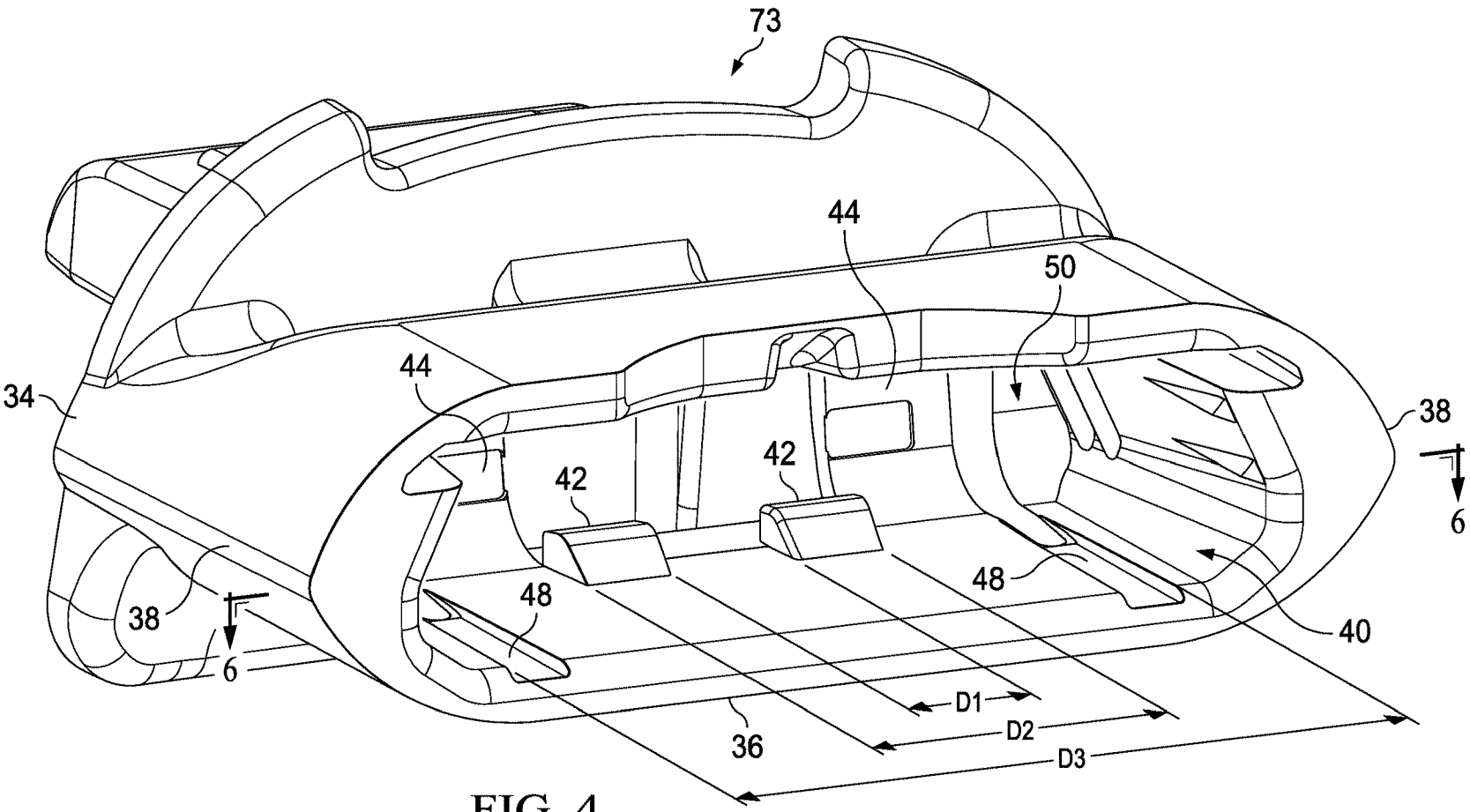
FIG. 4 is a rear isometric view depicting the adapter of FIG. 1.

Referring now to FIG. 4, the handle engaging portion 30 can comprise an upper wall 34, a lower wall 36 and a pair of sidewalls 38 that cooperate to define a receptacle 40. The receptacle 40 can be the same general shape as the stem 18 of the handle 12 to allow the stem 18 to be received in the receptacle 40. A pair of handle protrusions 42 can extend from the lower wall 36 towards the upper wall 38. The pair of handle protrusions 42 can be spaced apart from each other by a distance D1 that is substantially the same distance between the recesses 22 on the lower surface of the stem 18 of the handle 12. When the stem 18 is inserted in the receptacle 40, each of the handle protrusions 42 can extend into one of the recesses 22 to facilitate selective retention of the adapter 16 to the handle 12.

Figure 5:
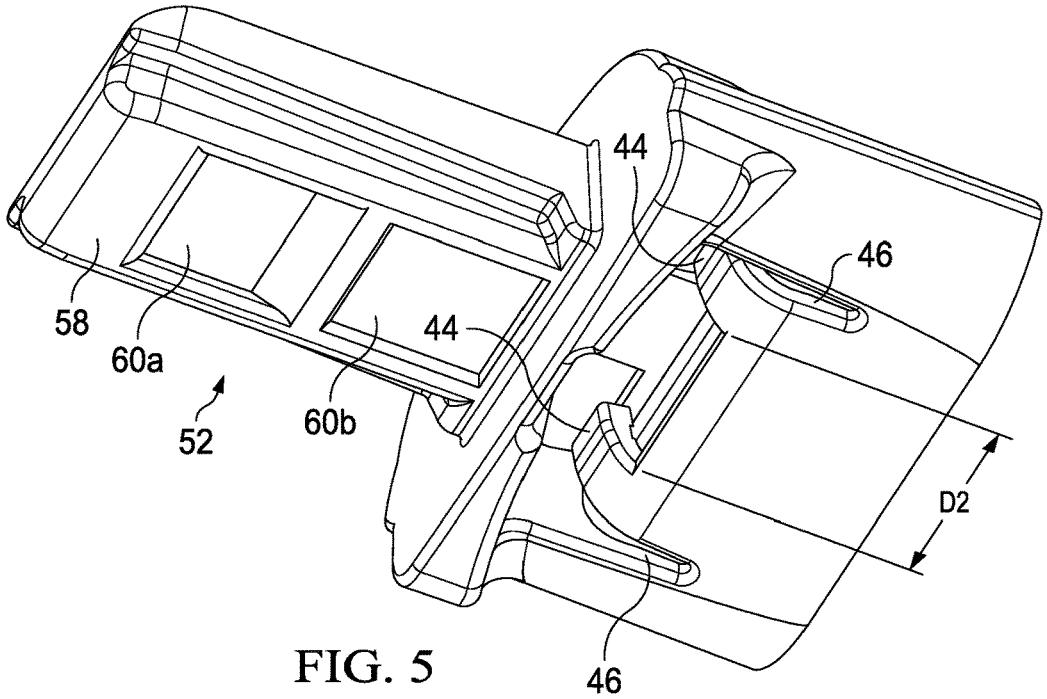
FIG. 5 is a lower rear isometric view depicting the adapter of FIG. 1.

Referring now to FIGS. 4 and 5, the handle engaging portion 30 can further comprise a pair of arms 44 that each extend from the lower wall 36 towards the upper wall 34. The pair of arms 44 is spaced apart by a distance D2 (FIG. 5) that is greater than the distance D1 between the handle protrusions 42. The lower wall 36 can define a pair of slots 46 that are adjacent to the pair of arms 44 and allow for relative movement of the pair of arms 44 away from the upper wall 34. When the stem 18 is inserted into the receptacle 40, the tongue member 24 can extend between the pair of arms 44 and the stem 18 can contact the pair of arms 44. When the stem 18 is inserted into the receptacle 40 such that the adapter 16 is coupled with the handle 12, the button 28 of the handle 12 can be actuated to facilitate ejection of the adapter 16 from the handle 12. Actuating the button 28 can cause the push member 27 to move to the extended position and push against the pair of arms 44 to flex the arms 44 downwardly to disengage the protrusions 42 from the stem 18. The compressed spring 26 can thus facilitate ejection of the adapter 16 from the handle 12.

Figure 6:
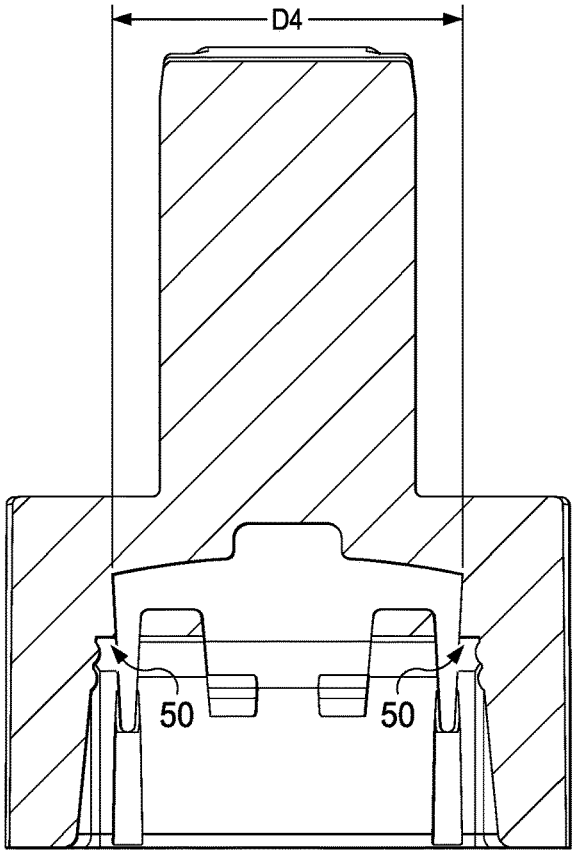
FIG. 6 is a cross sectional view taken along the line 6-6 of FIG. 4.

Referring now to FIGS. 4 and 6, the adapter 16 can also include a pair of elongate grooves 48 that are defined by the lower wall 38 and spaced apart by a distance D3. The distance D3 can be greater that the distance D2. The adapter 16 can also include a pair of end portions 50 that each extend from one of the sidewalls 38. The end portions 50 can be spaced apart by a distance D4 which can be greater than the distance D3.

Figure 7:
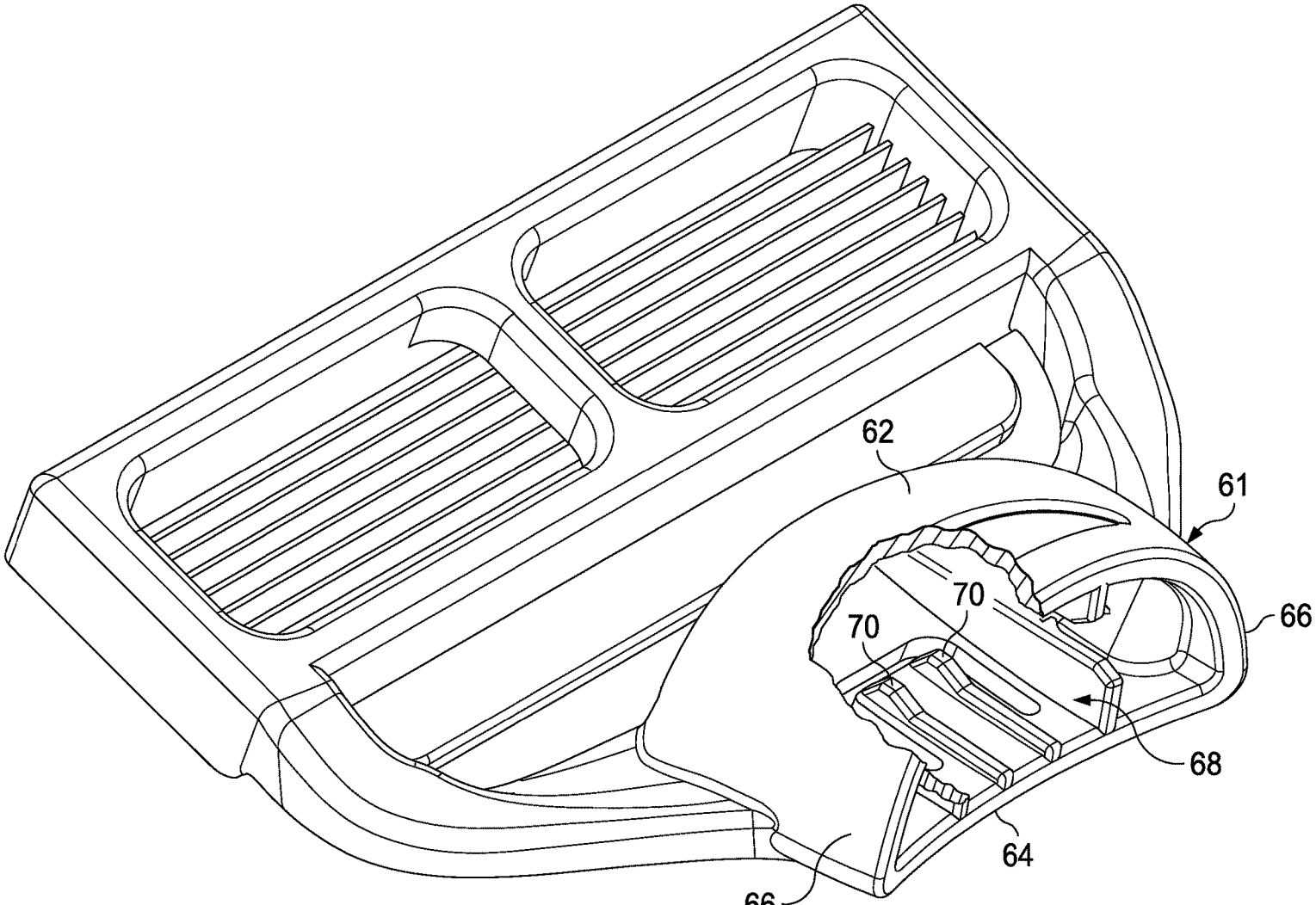
FIG. 7 is an isometric view depicting the cartridge of FIG. 1.

Referring again to FIG. 3, the cartridge engaging portion 32 can be configured to receive a HARRY'S® razor cartridge and can comprise a stem 52 and a collar 54 that is slidably coupled with the stem 52. The stem 52 can include an upper surface 56 and a lower surface 58 (FIG. 5). As illustrated in FIG. 5, the lower surface 58 can define a front recess 60*a* and a rear recess 60*b* for selectively engaging the cartridge 14 and the collar 54, respectively. As illustrated in FIGS. 3 and 7, the cartridge 14 can include a neck portion 61 that includes an upper wall 62, a lower wall 64 and a pair of sidewalls 66 that cooperate to define a receptacle 68. The receptacle 68 can be the same general shape as the stem 52 to allow the stem 52 to be received into the receptacle 68. As illustrated in FIG. 7, a pair of neck protrusions 70 can extend from the lower wall 64 towards the upper wall 62 and can be spaced apart from each other. When the stem 52 is inserted in the receptacle 68, each of the neck protrusions 70 can extend into the front recess 60*a* of the stem 52 to facilitate selective retention of the adapter 16 to the cartridge 14.

When the cartridge 14 is attached to the adapter 16 with the stem 52 inserted into the receptacle 68, the collar 54 can be sandwiched between the neck portion 61 and a shoulder 72 (FIG. 3) of the adapter 16 such that the collar 54 is in the resting position. To eject the cartridge 14 from the adapter 16, the collar 54 can be slid forward and away from the shoulder 72 to the ejected position which can overcome the frictional engagement between the neck protrusions 70 and the front recess 60*a* to push the cartridge 14 away from the stem 52. As illustrated in FIG. 3, the shoulder 72 can define a notch 73 that allows a user's finger to more easily contact the collar 54 when pushing the cartridge away from the stem 52.

Figure 8:
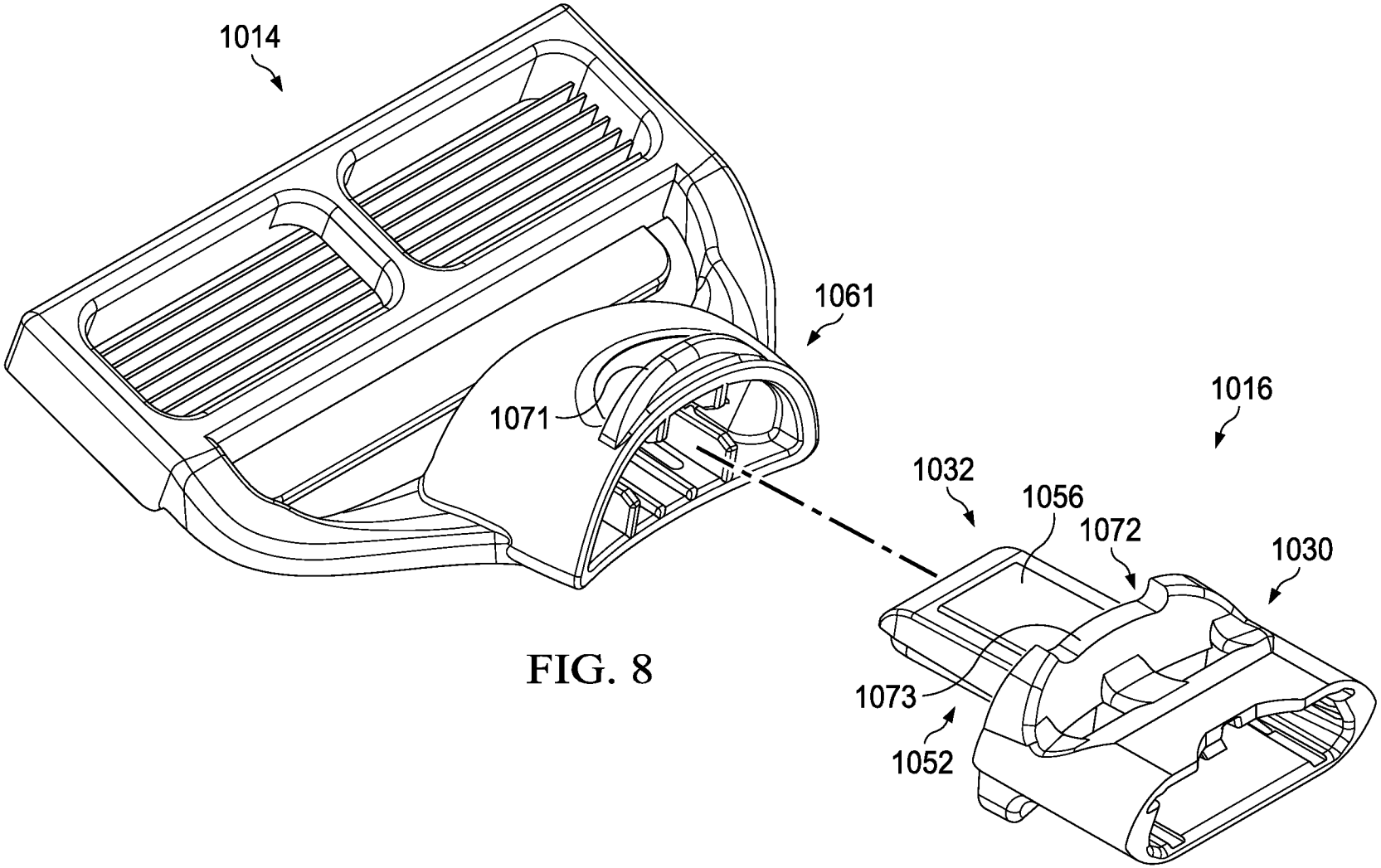
FIG. 8 is an exploded isometric view depicting a handle, a cartridge, and an adapter, in accordance with another one embodiment.

FIG. 8 illustrates a cartridge 1014 and an adapter 1016 according to another embodiment. The cartridge 1014 and the adapter 1016 can be similar to or the same as in many respects as the cartridge 14 and the adapter 16, respectively, of FIGS. 1-7. For example, the adapter 1016 can include a handle engaging portion 1030 and a cartridge engaging portion 1032. The cartridge engaging portion 1032 can comprise a stem 1052 that includes an upper surface 1056 and a lower surface (not shown). The adapter 1016 can include a shoulder 1072 that is adjacent to the stem 1052.

However, the adapter 1016 is devoid of a collar (e.g., 54). Instead, when the cartridge 1014 is installed on the stem 1052, a neck portion 1061 of the cartridge 1014 can abut (e.g., contact) the shoulder 1072. The cartridge 1014 can include a tab portion 1071 which can facilitate ejection of the cartridge 1014 from the adapter 1016. For example, when the cartridge 1014 is installed on the stem 1052, a user can access the tab 1071 through a notch 1073 to push the cartridge 1014 away from the stem 1052 to eject the cartridge 1014 from the adapter 1016.

Figure 9:
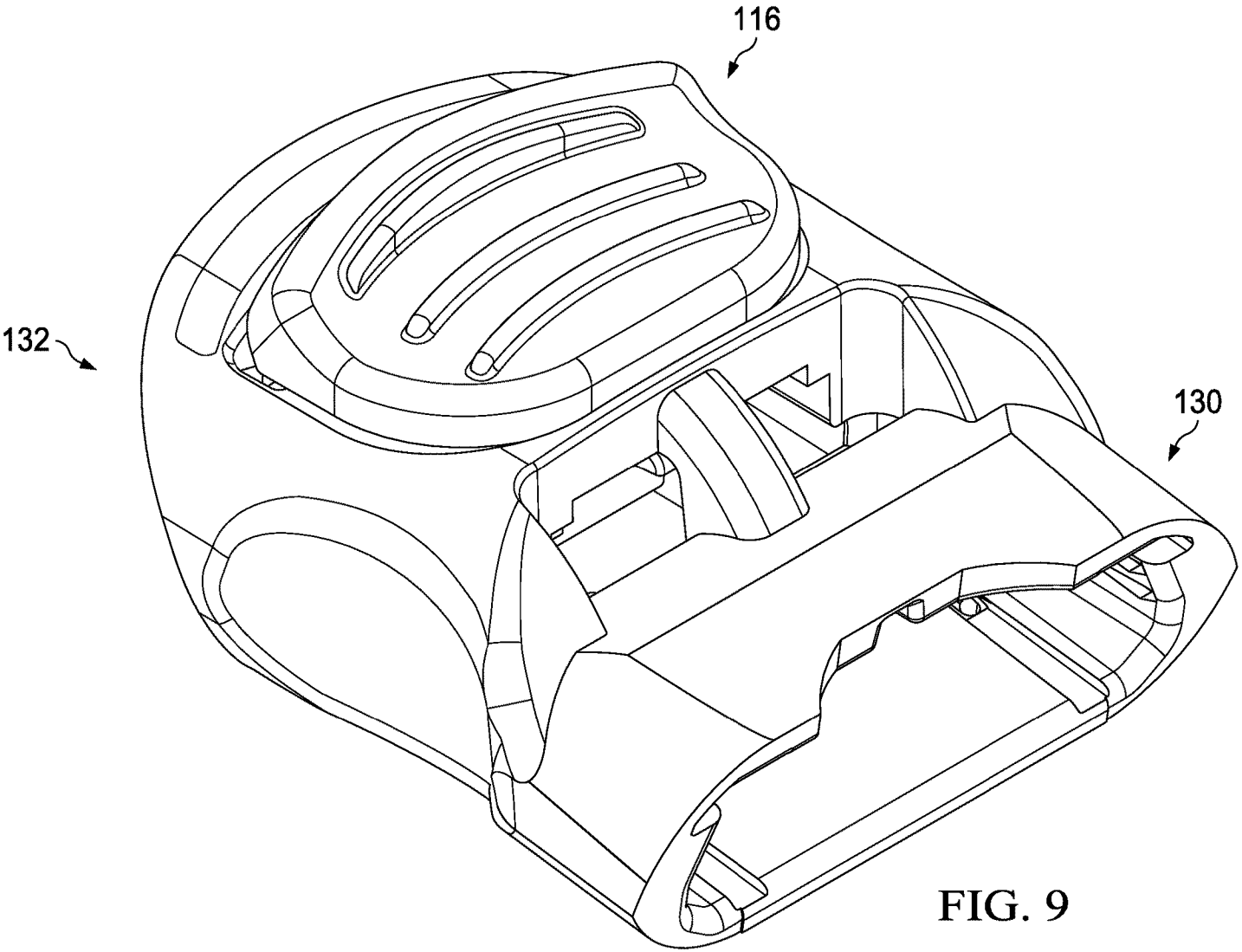
FIG. 9 is a rear isometric view depicting an adapter in accordance with another embodiment.
Figure 10:
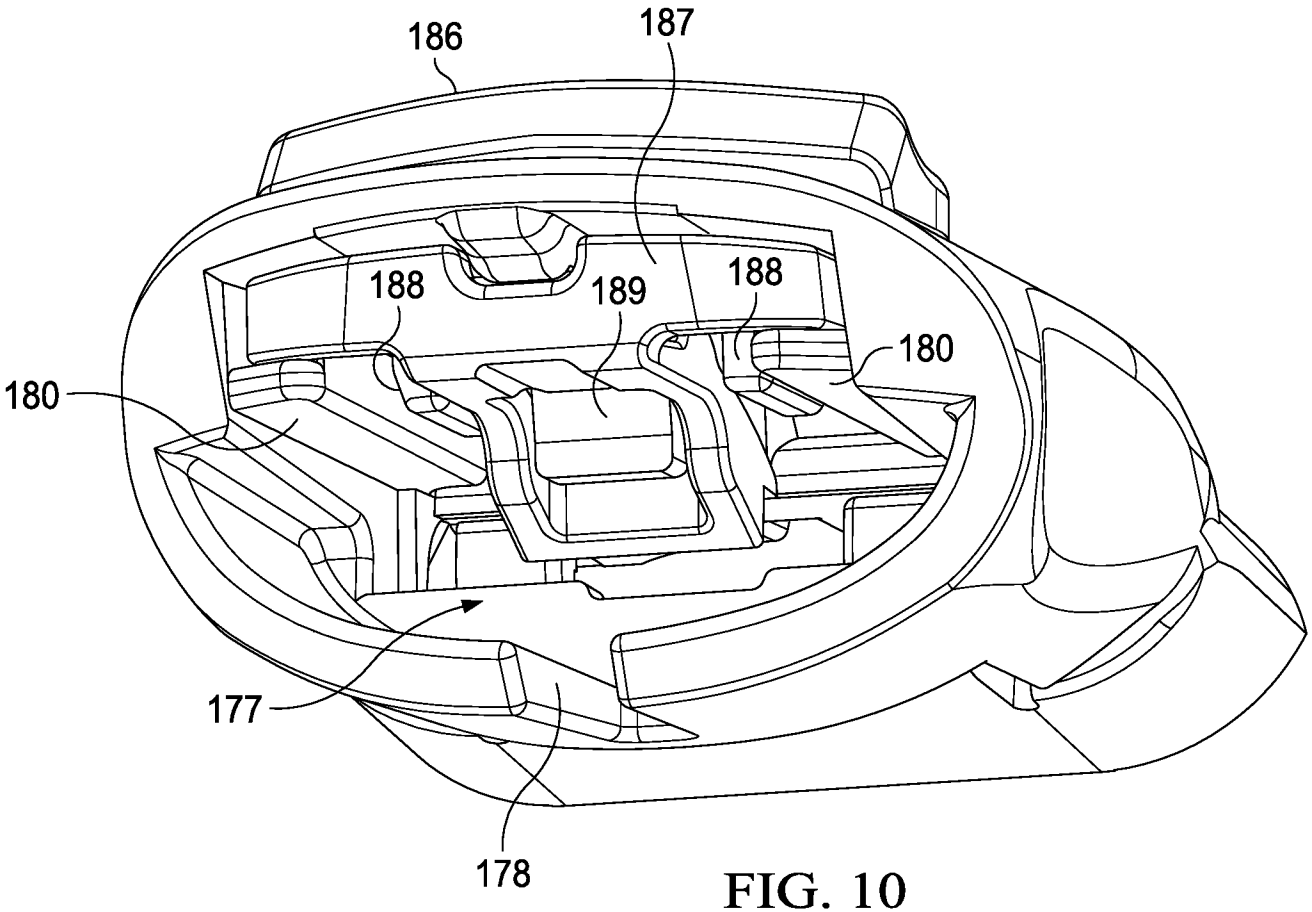
FIG. 10 is a front isometric view of the adapter of FIG. 9.
Figure 11:
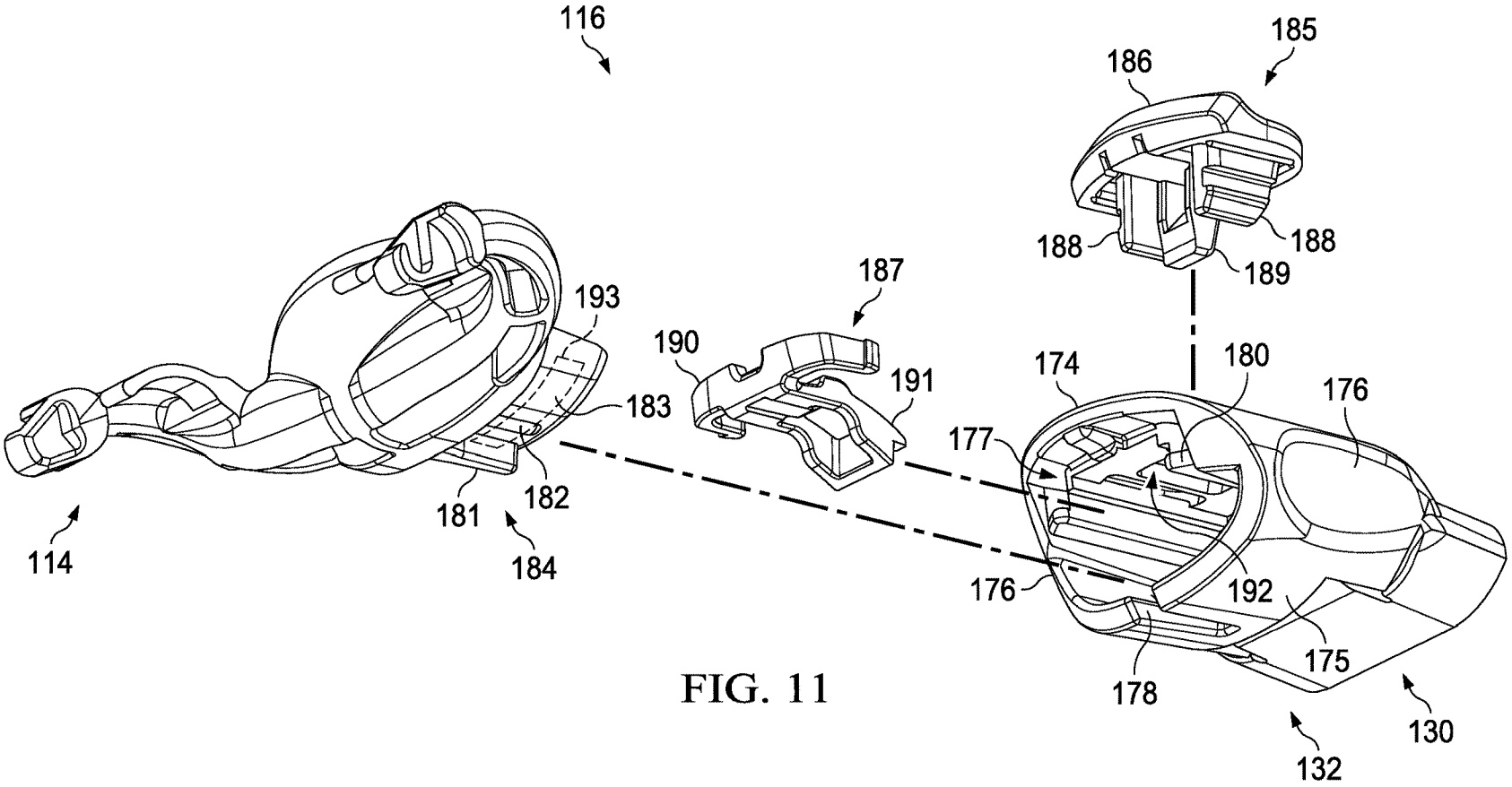
FIG. 11 is an exploded isometric view of the adapter of FIG. 9 in association with a portion of a compatible cartridge.

FIGS. 9-11 illustrate an adapter 116 according to another embodiment. The adapter 116 can be similar to or the same as in many respects as the adapter 16 of FIGS. 1-7. For example, adapter 116 can include a handle engaging portion 130 and a cartridge engaging portion 132 that are coupled together. The handle engaging portion 130 can be configured similar to the handle engaging portion 30 of FIGS. 1-7 such that the handle engaging portion 130 can be releasably mounted to a handle (e.g., 12) having a GILLETTE MACH3® docking interface.

However, the cartridge engaging portion 132 can be configured to receive a razor cartridge that is compatible with the AMERICAN SAFETY RAZOR® (ASR) docking interface. For example, the cartridge engaging portion 132 can include an upper wall 174, a lower wall 175, and a pair of sidewalls 176 that cooperate to define a receptacle 177. As illustrated in FIGS. 10 and 11, the lower wall 175 can define an elongate slot 178. A shoulder 180 (FIG. 10) can extend from each of the sidewalls 176 into the receptacle 177. As illustrated in FIG. 11, a cartridge 114 can include a central protrusion 181 and a pair of boundary protrusions 182 (one shown) disposed on an outer surface 183 of a support member 184 of the cartridge 114. The central protrusion 181 can be spaced from, and disposed between, the boundary protrusions 182 and can have a greater height than the boundary protrusions 182. When the support member 184 is inserted into the receptacle 177 to secure the cartridge 114 to the adapter 116, the central protrusion 181 can extend through the elongate slot 178 of the lower wall 175. The boundary protrusions 182 can contact the lower wall 175 adjacent to the elongate slot 178 to facilitate frictional engagement between the support member 184 and the cartridge engaging portion 132. One example of such an ASR docking interface is disclosed in U.S. Pat. No. 8,079,147, which is hereby incorporated by reference in its entirety.

As illustrated in FIG. 11, the adapter 116 can also include a button assembly 185 having a button 186 and an ejecting member 187. The button 186 and the ejecting member 187 can be coupled together and the button 186 can be pivotably coupled with the upper wall 174 and pivotal between a resting position and an ejecting position. The button 186 can include a pair of clip members 188 and a post 189 disposed between the clip members 188. The ejecting member 187 can include a securing portion 190 and an engagement portion 191 extending beneath the securing portion 190. The ejecting member 187 can be disposed within the receptacle 177 and the shoulders 180 can provide underlying support for the securing portion 190. The button 186 can be disposed within an aperture 192 defined by the upper wall 174 and movably secured to the upper wall 174 by the clip members 188. With the button 186 disposed in the aperture 192, the post 189 can extend into the engagement portion 191 of the ejecting member 187. When the cartridge 114 is installed in the receptacle 177, the engagement portion 191 can extend into an upper recess 193 (FIG. 11) defined by the support member 184. When the button 186 is pivoted forwardly (e.g., towards the cartridge 114), the post 189 can urge (e.g., flex) the engagement portion 191 upwardly and away from the upper recess 193 of the cartridge 114 thus allowing the cartridge 114 to be removed from the support member 184.

Figure 12:
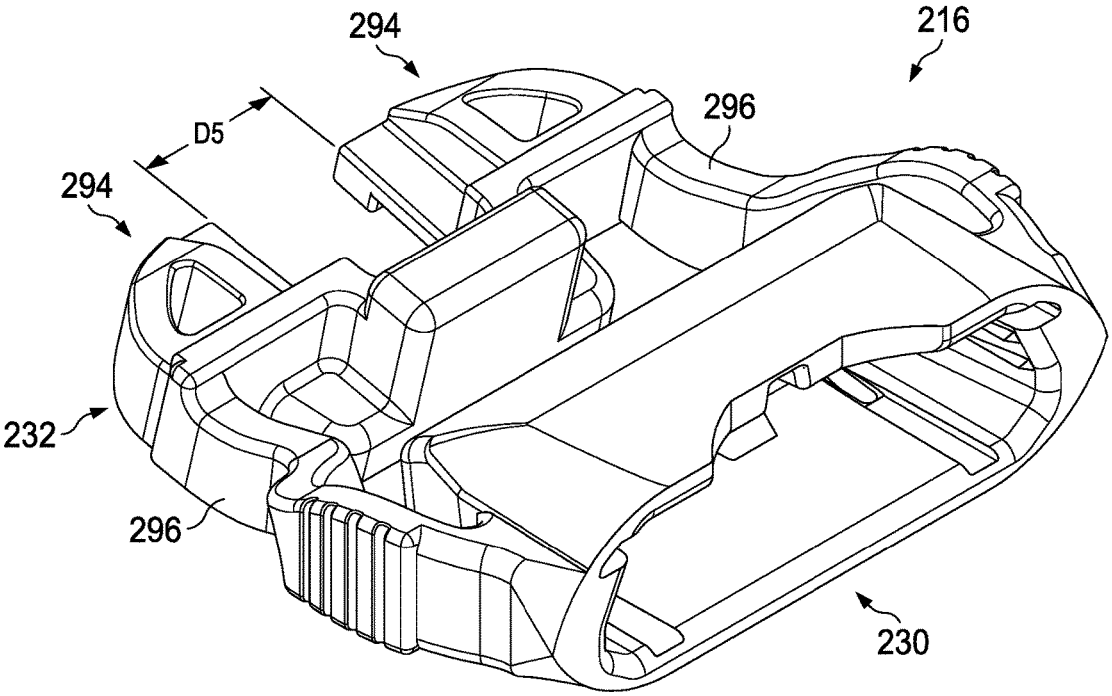
FIG. 12 is an upper isometric view depicting an adapter in accordance with yet another embodiment.
Figure 13:
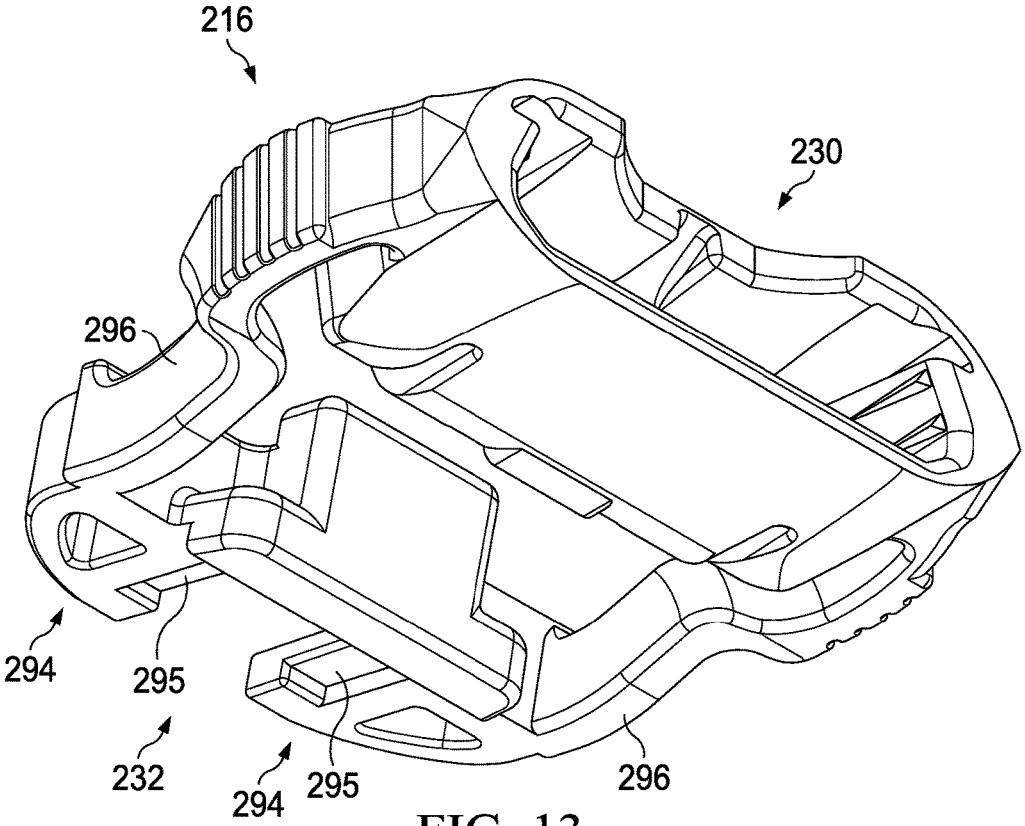
FIG. 13 is a lower isometric view depicting the adapter of FIG. 12.

FIGS. 12-13 illustrate an adapter 216 according to another embodiment. The adapter 216 can be similar to or the same as in many respects as the adapter 16 of FIGS. 1-7. For example, adapter 216 can include a handle engaging portion 230 and a cartridge engaging portion 232 that are coupled together. The handle engaging portion 230 can be configured similar to the handle engaging portion 30 of FIGS. 1-7 such that the handle engaging portion 230 can be releasably mounted to a handle (e.g., 12) having a GILLETTE MACH3® docking interface.

However, the cartridge engaging portion 232 can be configured to receive a razor cartridge that is compatible with a DORCO® docking interface. For example, the cartridge engaging portion 232 can include a pair of stems 294 that each define a recess 295 for selectively engaging a respective cartridge protrusion of a cartridge (not shown). The stems 294 can be spaced apart by a distance D5 that is greater than the width of a central blocking portion (not shown) of a cartridge (not shown). When the DORCO® cartridge is installed on the cartridge engaging portion 232, the central blocking portion can be interposed between the stems 294 and the cartridge protrusions of the cartridge can extend into the recesses 295 to facilitate frictional engagement between the stems 294 and the cartridge. One example of such a DORCO® docking interface is disclosed in U.S. Pat. No. 8,590,162, which is hereby incorporated by reference in its entirety.

The cartridge engaging portion 232 can be pivotally coupled with the handle engaging portion 230. As illustrated in FIGS. 12 and 13, the adapter 216 can comprise a pair of resilient members 296 that facilitate pivotal coupling of the handle engaging portion 230 and the cartridge engaging portion 232 together. In one embodiment, the resilient members 296 can be formed of an elastomeric material, such as rubber, for example, that allows the handle engaging portion 230 and the cartridge engaging portion 232 to flex relative to each other. It is to be appreciated that, in some embodiments, the adapter 216 and the DORCO® cartridge can be sufficiently coupled together such that the adapter 216 is disposable with the DORCO® cartridge. In other embodiments, the adapter 216 can be manually decoupled from the DORCO® cartridge by pulling the DORCO® cartridge and the adapter 216 away from each other with enough force to overcome the frictional interaction between the DORCO® cartridge and the stem 234.

Figure 14:
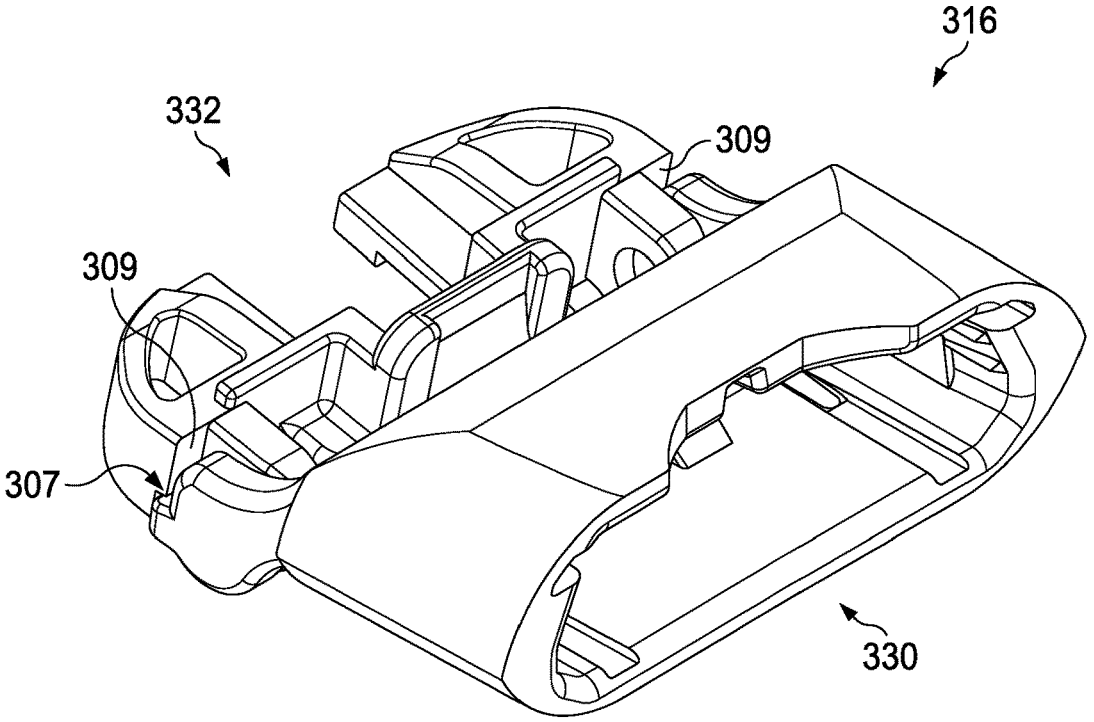
FIG. 14 is an upper isometric view depicting an adapter in accordance with still yet another embodiment.
Figure 15:
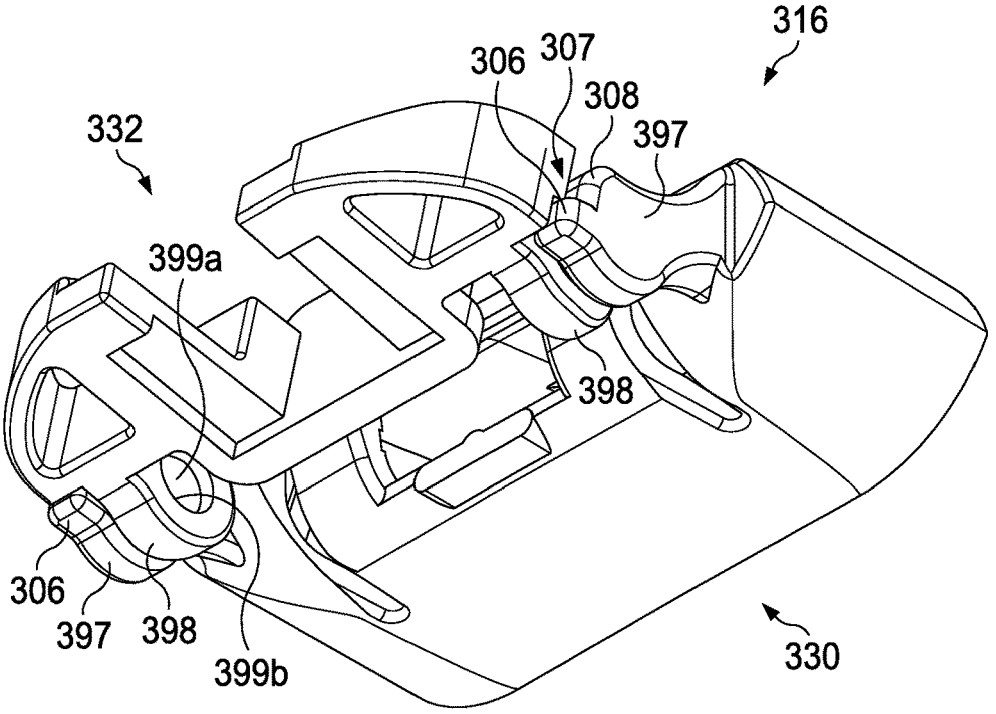
FIG. 15 is a lower isometric view depicting the adapter of FIG. 14.

FIGS. 14-15 illustrate an adapter 316 according to another embodiment. The adapter 316 can be similar to or the same as in many respects as the adapter 216 of FIGS. 12-13. For example, adapter 316 can include a handle engaging portion 330 and a cartridge engaging portion 332 that are pivotably coupled together. The handle engaging portion 330 can be configured similar to the handle engaging portion 30 of FIGS. 1-7 such that the handle engaging portion 330 can be releasably mounted to a handle (e.g., 12) having a GILLETTE MACH3® docking interface. The cartridge engaging portion 332 can be configured similar to the cartridge engaging portion 232 of FIGS. 12-13 such that the cartridge engaging portion 332 can be releasably mounted to a handle (e.g., 12) having a DORCO® docking interface.

However, the handle engaging portion 330 and the cartridge engaging portion 332 can include respective pairs of first hinged members 397 and second hinged members 398. In one embodiment, as illustrated in FIGS. 14 and 15, each of the first hinged members 397 can comprise a pin 399*a* and each of the second hinged members 398 can define an aperture 399*b*. Each of the pins 399*a* can extend at least partially into one of the apertures 399*b* to facilitate hinged coupling between the first and second hinged members 397, 398.

Figure 16:
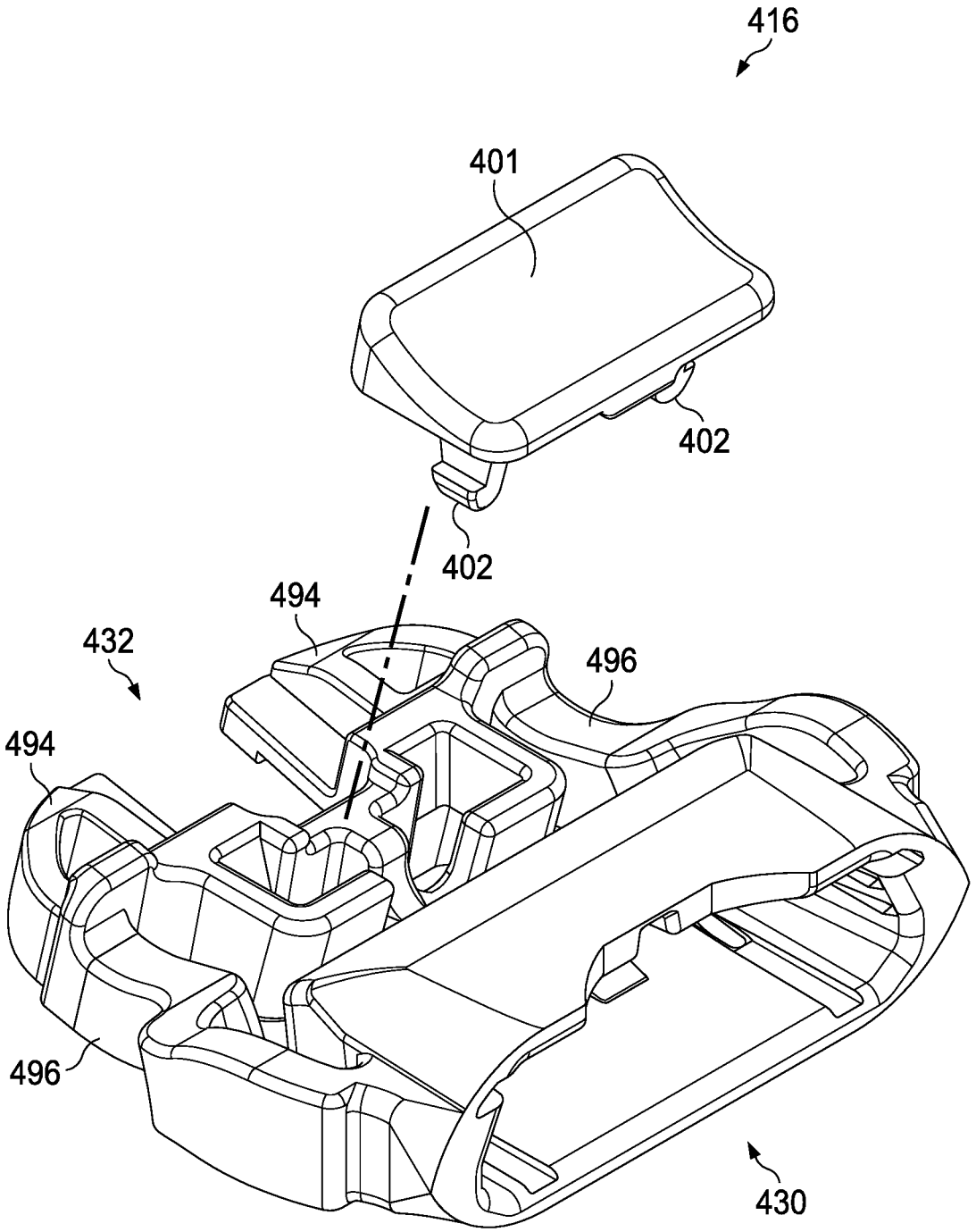
FIG. 16 is an exploded view depicting an adapter in accordance with still yet another embodiment.

FIG. 16 illustrates an adapter 416 according to another embodiment. The adapter 416 can be similar to or the same as in many respects as the adapters 216, 316 of FIGS. 12-13 and 14-15 respectively. For example, adapter 416 can include a handle engaging portion 430 and a cartridge engaging portion 432 that are pivotably coupled together. The cartridge engaging portion 432 can comprise a pair of resilient members 496 that facilitate pivotal coupling of the handle engaging portion 430 and the cartridge engaging portion 432 together. The handle engaging portion 430 can be configured similar to the handle engaging portion 30 of FIGS. 1-7 such that the handle engaging portion 430 can be releasably mounted to a handle (e.g., 12) having a GILLETTE MACH3® docking interface. The cartridge engaging portion 432 can be configured similar to the cartridge engaging portion 232 of FIGS. 12-13 such that the cartridge engaging portion 432 can be releasably mounted to a handle (e.g., 12) having a DORCO® docking interface.

However, the cartridge engaging portion 432 can include a button 401 that includes a pair of clip members 402. Each of the clip members 402 can be releasably secured to one of a pair of stems 494 and pivotable with respect to the pair of stems 494 between a resting position and an ejecting position. When a cartridge (not shown) is installed on the cartridge engaging portion 432, the button 401 can be in the resting position. When the button 401 is moved to the ejecting position, the button 401 can contact the cartridge (not shown) to facilitate ejection of the cartridge from the cartridge engaging portion 432.

Figure 17:
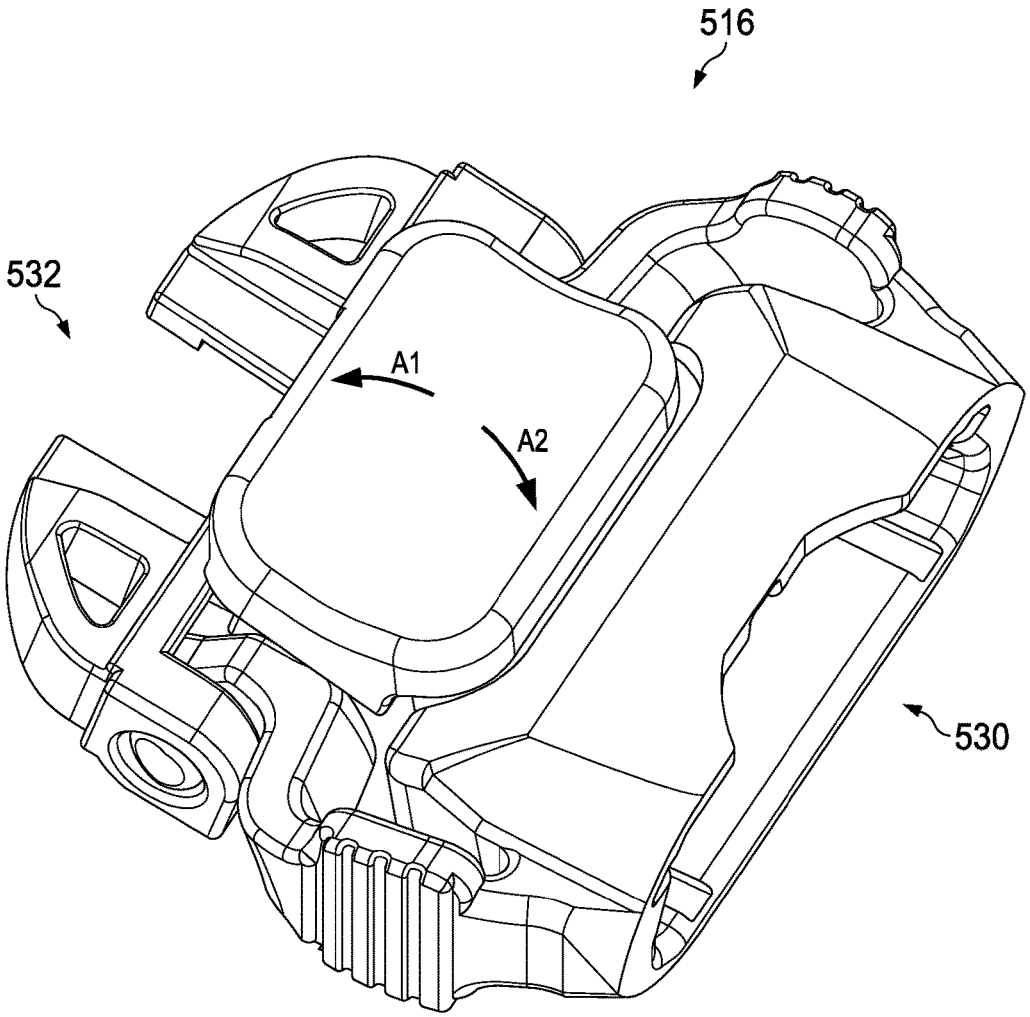
FIG. 17 is an upper isometric view depicting an adapter in accordance with still yet another embodiment.
Figure 18:
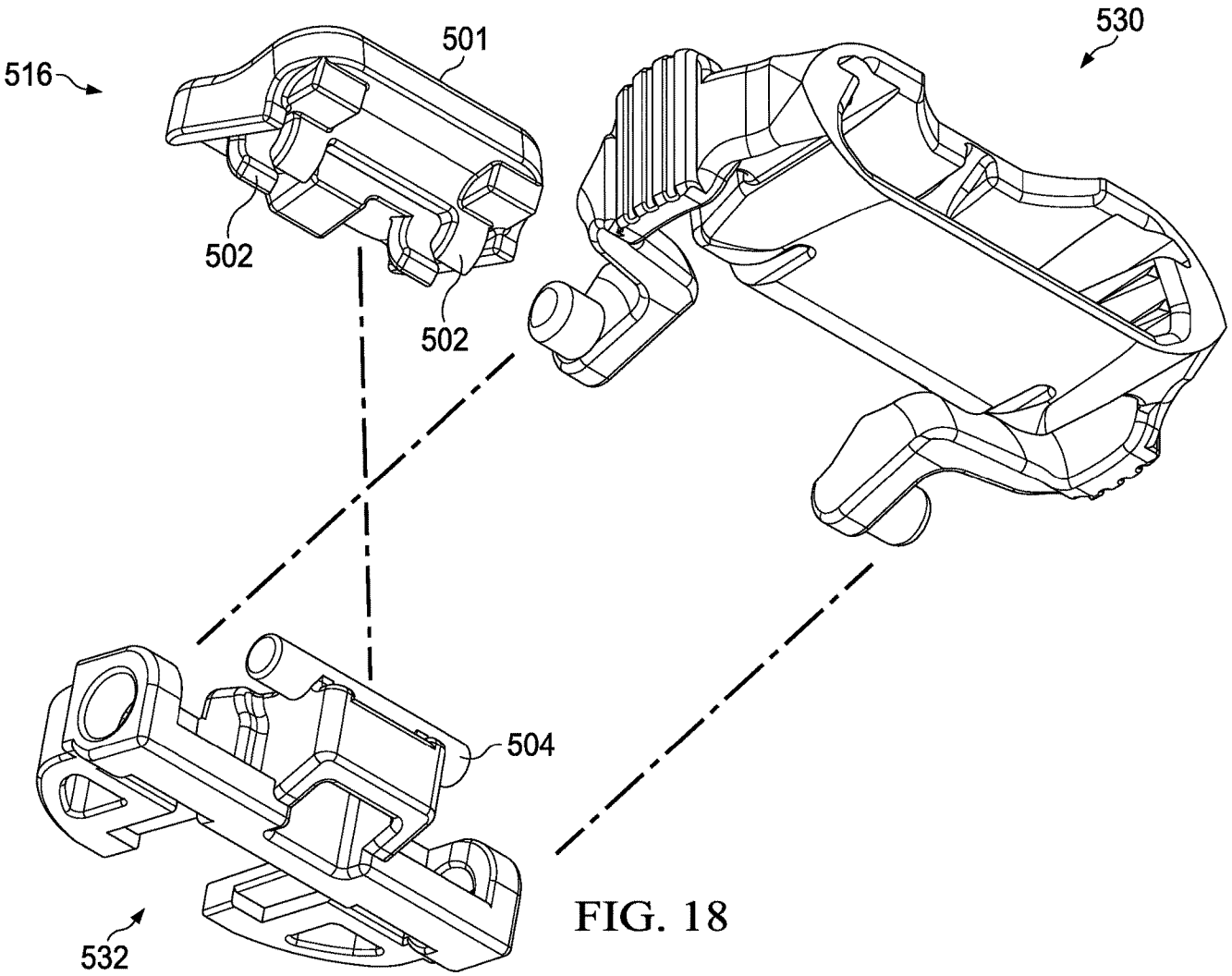
FIG. 18 is an exploded isometric view depicting the adapter of FIG. 17.

FIGS. 17-18 illustrate an adapter 516 according to another embodiment. The adapter 516 can be similar to or the same as in many respects as the adapters 216, 316, 416 of FIGS. 12-13, 14-15, and 16 respectively. For example, adapter 516 can include a handle engaging portion 530 and a cartridge engaging portion 532 that are pivotably coupled together. The handle engaging portion 530 can be configured similar to the handle engaging portion 30 of FIGS. 1-7 such that the handle engaging portion 530 can be releasably mounted to a handle (e.g., 12) having a GILLETTE MACH3® docking interface. The cartridge engaging portion 532 can be configured similar to the cartridge engaging portion 232 of FIGS. 12-13 such that the cartridge engaging portion 532 can be releasably mounted to a handle (e.g., 12) having a DORCO® docking interface. The cartridge engaging portion 532 can include a button 501 that includes a pair of clip members 502.

However, each of the clip members 502 can be releasably secured to one of a pair of shafts 504 (one shown) and can be pivotable with respect to the pair of shafts 504 between a resting position, a cartridge ejecting position, and a handle ejecting position. When a handle and cartridge (not shown) are installed on the handle and cartridge engaging portions 530, 532, respectively, the button 501 can be in the resting position. When the button 501 is moved forwardly to the cartridge ejecting position, the button 501 can contact a blocking member of the cartridge to facilitate ejection of the cartridge from the cartridge engaging portion 532. When the button 501 is moved rearwardly to the handle ejecting position, the button 501 can contact a stem or other portion of the handle to facilitate ejection of the handle from the handle engaging portion 530.

Combinations

A. An adapter for coupling each of a razor handle and a razor cartridge together, the adapter comprising:
   - a handle engaging portion comprising:
     - at least one wall that defines a receptacle for receiving a razor handle;
     - a first handle protrusion extending from the at least one wall; and
     - a second handle protrusion extending from the at least one wall and being spaced from the first handle protrusion;

wherein the first handle protrusion and the second handle protrusion are configured to extend into a first recess and a second recess, respectively, of a stem of a razor handle;

a cartridge engaging portion coupled with the handle engaging portion, the cartridge engaging portion comprising:

a stem that defines a recess for selectively engaging a cartridge protrusion; and a collar slidably coupled with the stem and slidable between a resting position and an ejecting position;

wherein sliding the collar from the resting position to the ejecting position facilitates ejection of a cartridge from the stem.

B. The adapter according to Paragraph A wherein the at least one wall comprises an upper wall and a lower wall and the first handle protrusion and the second handle protrusion extend from the lower wall.

C. The adapter according to any one of Paragraphs A and B wherein the handle engaging portion further comprises a pair of arms that extend from the lower wall.

D. The adapter according to any one of Paragraphs A-C wherein:

the first handle protrusion and the second handle protrusion are spaced apart by a first distance;

the pair of arms are spaced apart by a second distance; and the first distance is less than the second distance.

E. The adapter according to Paragraph A wherein the stem defines a front recess and a lower recess.

F. The adapter according to Paragraph A wherein the cartridge engaging portion defines a notch that facilitates access to a cartridge for releasing of the cartridge from the adapter.

G. The adapter according to Paragraph A wherein the cartridge engaging portion is coupled with the handle engaging portion in a unitary one piece construction.

H. An adapter for coupling each of a razor handle and a razor cartridge together, the adapter comprising:

a handle engaging portion comprising:

at least one first wall that defines a first receptacle for receiving a razor handle;

a first handle protrusion extending from the at least one first wall; and a second handle protrusion extending from the at least one first wall and being spaced from the first handle protrusion;

wherein the first handle protrusion and the second handle protrusion are configured to extend into a first recess and a second recess, respectively, of a stem of a razor handle;

a cartridge engaging portion coupled with the handle engaging portion, the cartridge engaging portion comprising:

at least one second wall that defines a second receptacle; and a button assembly movably coupled with the at least one second wall and movable between a resting position and an ejecting position;

wherein moving the button assembly from the resting position to the ejecting position facilitates ejection of a cartridge from the cartridge engaging portion.

I. The adapter according to Paragraph H wherein the at least one second wall comprises a second upper wall and a second lower wall and the second lower wall defines an elongate slot.

J. The adapter according to any of Paragraphs H and I wherein the button assembly comprises a button that is pivotably coupled with the upper wall and facilitates pivoting of the button assembly between the resting position and the ejecting position.

K. The adapter according to any of Paragraphs H-J wherein the button assembly further comprises an ejecting member coupled with the button and slidable in response to pivoting of the button between the resting position and the ejecting position.

L. The adapter according to Paragraph H wherein the at least first one wall comprises a first upper wall and a first lower wall and the first handle protrusion and the second handle protrusion extend from the first lower wall.

M. The adapter according to Paragraph L further comprising a pair of arms that extend from the first lower wall.

N. The adapter according to Paragraph L wherein:

the first handle protrusion and the second handle protrusion are spaced apart by a first distance;

the pair of arms are spaced apart by a second distance; and the first distance is less than the second distance.

O. The adapter according to any of Paragraphs L-N wherein:

the first lower wall defines a pair of grooves that are spaced apart by a third distance; and the second distance is less than the third distance.

P. The adapter according to any of Paragraphs L-O further comprising a pair of end portions that each extend between the first upper wall and the first lower wall and are spaced apart by a fourth distance and the third distance is less than the fourth distance.

Q. The adapter according to Paragraph H wherein the cartridge engaging portion is coupled with the handle engaging portion in a unitary one piece construction.

R. An adapter for coupling each of a razor handle and a razor cartridge together, the adapter comprising:

a handle engaging portion comprising:

at least one wall that defines a receptacle for receiving a razor handle;

a first handle protrusion extending from the at least one wall; and a second handle protrusion extending from the at least one wall and being spaced from the first handle protrusion;

wherein the first handle protrusion and the second handle protrusion are configured to extend into a first recess and a second recess, respectively, of a stem of a razor handle; and a cartridge engaging portion coupled with the handle engaging portion, the cartridge engaging portion comprising:

a first stem that defines a first recess for selectively engaging a first cartridge protrusion; and a second stem that defines a second recess for selectively engaging a second cartridge protrusion.

S. The adapter according to Paragraph R wherein the at least one wall comprises an upper wall and a lower wall and the first handle protrusion and the second handle protrusion extend from the lower wall.

T. The adapter according to Paragraph S further comprising a pair of arms that extend from the lower wall.

U. The adapter according to Paragraph T wherein:

the first handle protrusion and the second handle protrusion are spaced apart by a first distance;

the pair of arms are spaced apart by a second distance; and the first distance is less than the second distance.

V. The adapter according to according to Paragraph U wherein:

the lower wall defines a pair of grooves that are spaced apart by a third distance; and the second distance is less than the third distance.

W. The adapter according to Paragraph V further comprising a pair of end portions that each extend between the upper wall and the lower wall and are spaced apart by a fourth distance and the third distance is less than the fourth distance.

X. The adapter according to Paragraph W wherein:
the first stem and the second stem are spaced apart by a fifth distance; and
the first distance is less than the fifth distance.

Y. The adapter according to any of Paragraphs R-X wherein the cartridge engaging portion is pivotally coupled with the handle engaging portion.

Z. The adapter according to any of Paragraphs R-Y further comprising a pair of resilient members that facilitate pivotal coupling of the cartridge engaging portion with the handle engaging portion.

AA. The adapter according to Paragraph Z wherein the resilient members are formed of an elastomeric material.

BB. The adapter according to any of Paragraphs R-Y wherein the cartridge engaging portion and the handle engaging portion are hingedly coupled together.

CC. The adapter according to any of Paragraphs R-BB further comprising a button assembly movably coupled with one of the cartridge engaging portion and the handle engaging portion and movable between a resting position and an ejecting position wherein moving the button assembly from the resting position to the ejecting position facilitates ejection of a cartridge from the cartridge engaging portion.

DD. The adapter according to Paragraph CC further comprising a button movably coupled with one of the cartridge engaging portion and the handle engaging portion and operable to facilitate movement of the button assembly between the resting position and the cartridge release position wherein moving the button assembly with the button from the resting position to the cartridge release position facilitates ejection of a cartridge from the cartridge engaging portion.

EE. The adapter according to Paragraph DD further comprising a shaft coupled with the button that engages a cartridge to facilitate ejection of the cartridge from the cartridge engagement portion.

FF. The adapter according to any of Paragraphs R-EE wherein the button assembly is further movable between the resting position and a handle release position wherein moving the button assembly from the resting position to the handle release position facilitates ejection of a handle from the handle engaging portion.

GG. The adapter according to Paragraph FF further comprising a shaft coupled with the button that engages a handle to facilitate ejection of the handle from the handle engagement portion.

HH. An adapter for coupling each of a razor handle and a razor cartridge together, the adapter comprising:
a handle engaging portion comprising:
at least one wall that defines a receptacle for receiving a razor handle;
a first handle protrusion extending from the at least one wall; and
a second handle protrusion extending from the at least one wall and being spaced from the first handle protrusion;
wherein the first handle protrusion and the second handle protrusion are configured to extend into a first recess and a second recess, respectively, of a stem of a razor handle;
a cartridge engaging portion; and
a pair of resilient members that facilitate pivotal coupling of the cartridge engaging portion with the handle engaging portion.

II. The adapter according to Paragraph HH wherein the resilient members are formed of an elastomeric material.

JJ. The adapter according to any of Paragraphs HH and II further comprising a button assembly movably coupled with one of the cartridge engaging portion and the handle engaging portion and movable between a resting position and an ejecting position wherein moving the button assembly from the resting position to the ejecting position facilitates ejection of a cartridge from the cartridge engaging portion.

KK. The adapter according to Paragraph JJ further comprising a button movably coupled with one of the cartridge engaging portion and the handle engaging portion and operable to facilitate movement of the button assembly between the resting position and the cartridge release position wherein moving the button assembly with the button from the resting position to the cartridge release position facilitates ejection of a cartridge from the cartridge engaging portion.

LL. The adapter according to Paragraph KK further comprising a shaft coupled with the button that engages a cartridge to facilitate ejection of the cartridge from the cartridge engagement portion.

MM. The adapter according to any of Paragraphs JJ-LL wherein the button assembly is further movable between the resting position and a handle release position wherein moving the button assembly from the resting position to the handle release position facilitates ejection of a handle from the handle engaging portion.

NN. The adapter according to any of Paragraphs KK-MM further comprising a shaft coupled with the button that engages a handle to facilitate ejection of the handle from the handle engagement portion.

OO. A kit comprising the adapter of any of claims A-NN in combination with a cartridge, the cartridge comprising a neck portion that comprises a tab that extends from the neck portion.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An adapter for coupling each of a razor handle and a razor cartridge together, the adapter comprising:

a handle engaging portion comprising:

at least one wall that defines a receptacle for receiving a razor handle;

a first handle protrusion extending from the at least one wall; and a second handle protrusion extending from the at least one wall and being spaced from the first handle protrusion;

wherein the first handle protrusion and the second handle protrusion are configured to extend into a first recess and a second recess, respectively, of a stem of a razor handle;

a cartridge engaging portion coupled with the handle engaging portion, the cartridge engaging portion comprising:

a stem that defines a recess for selectively engaging a cartridge protrusion; and a collar slidably coupled with the stem and slidable between a resting position and an ejecting position;

wherein sliding the collar from the resting position to the ejecting position facilitates ejection of a cartridge from the stem.

2. The adapter of claim 1 wherein at least two walls comprise an upper wall and a lower wall and the first handle protrusion and the second handle protrusion extend from the lower wall.

3. The adapter of claim 2 wherein the handle engaging portion further comprises a pair of arms that extend from the lower wall.

4. The adapter of claim 3 wherein:

the first handle protrusion and the second handle protrusion are spaced apart by a first distance;

the pair of arms are spaced apart by a second distance; and the first distance is less than the second distance.

5. The adapter of claim 1 wherein the stem defines a front recess and a rear recess.

6. The adapter of claim 1 wherein the cartridge engaging portion defines a notch that facilitates access to a cartridge for releasing of the cartridge from the adapter.

7. The adapter of claim 1 wherein the cartridge engaging portion is coupled with the handle engaging portion in a unitary one piece construction.

8. An adapter for coupling each of a razor handle and a razor cartridge together, the adapter comprising:

a handle engaging portion comprising:

at least one first wall that defines a first receptacle for receiving a razor handle;

a first handle protrusion extending from the at least one first wall; and a second handle protrusion extending from the at least one first wall and being spaced from the first handle protrusion;

wherein the first handle protrusion and the second handle protrusion are configured to extend into a first recess and a second recess, respectively, of a stem of a razor handle;

a cartridge engaging portion coupled with the handle engaging portion, the cartridge engaging portion comprising:

at least one second wall that defines a second receptacle; and a button assembly movably coupled with the at least one second wall and movable between a resting position and an ejecting position;

wherein moving the button assembly from the resting position to the ejecting position facilitates ejection of a cartridge from the cartridge engaging portion.

9. The adapter of claim 8 wherein at least two second walls comprise a second upper wall and a second lower wall and the second lower wall defines an elongate slot.

10. The adapter of claim 9 wherein the button assembly comprises a button that is pivotably coupled with the upper wall and facilitates pivoting of the button assembly between the resting position and the ejecting position.

11. The adapter of claim 10 wherein the button assembly further comprises an ejecting member coupled with the button and slidable in response to pivoting of the button between the resting position and the ejecting position.

12. The adapter of claim 8 wherein at least two first walls comprise a first upper wall and a first lower wall and the first handle protrusion and the second handle protrusion extend from the first lower wall.

13. The adapter of claim 12 further comprising a pair of arms that extend from the first lower wall.

14. The adapter of claim 13 wherein:

the first handle protrusion and the second handle protrusion are spaced apart by a first distance;

the pair of arms are spaced apart by a second distance; and the first distance is less than the second distance.

15. The adapter of claim 14 wherein:

the first lower wall defines a pair of grooves that are spaced apart by a third distance; and the second distance is less than the third distance.

16. The adapter of claim 15 further comprising a pair of end portions that each extend between the first upper wall and the first lower wall and are spaced apart by a fourth distance and the third distance is less than the fourth distance.

17. The adapter of claim 8 wherein the cartridge engaging portion is coupled with the handle engaging portion in a unitary one piece construction.

18. An adapter for coupling each of a razor handle and a razor cartridge together, the adapter comprising:

a handle engaging portion comprising:

at least one wall that defines a receptacle for receiving a razor handle;

a first handle protrusion extending from the at least one wall; and a second handle protrusion extending from the at least one wall and being spaced from the first handle protrusion;

wherein the first handle protrusion and the second handle protrusion are configured to extend into a first recess and a second recess, respectively, of a stem of a razor handle; and a cartridge engaging portion coupled with the handle engaging portion, the cartridge engaging portion comprising:

a first stem that defines a first recess for selectively engaging a first cartridge protrusion; and a second stem that defines a second recess for selectively engaging a second cartridge protrusion; and a button assembly movably coupled with one of the cartridge engaging portion and the handle engaging portion and movable between a resting position and an ejecting position wherein moving the button assembly from the resting position to the ejecting position facilitates ejection of a cartridge from the cartridge engaging portion.

19. The adapter of claim 18 wherein the at least one wall comprises an upper wall portion and a lower wall portion and the first handle protrusion and the second handle protrusion extend from the lower wall portion.

20. The adapter of claim 19 further comprising a pair of arms that extend from the lower wall.

21. The adapter of claim 20 wherein:

the first handle protrusion and the second handle protrusion are spaced apart by a first distance;

the pair of arms are spaced apart by a second distance; and the first distance is less than the second distance.

22. The adapter of claim 21 wherein:

the lower wall defines a pair of grooves that are spaced apart by a third distance; and the second distance is less than the third distance.

23. The adapter of claim 22 further comprising a pair of end portions that each extend between the upper wall and the lower wall and are spaced apart by a fourth distance and the third distance is less than the fourth distance.

24. The adapter of claim 23 wherein:

the first stem and the second stem are spaced apart by a fifth distance; and the first distance is less than the fifth distance.

25. The adapter of claim 18 wherein the cartridge engaging portion is pivotally coupled with the handle engaging portion.

26. The adapter of claim 25 further comprising a pair of resilient members that facilitate pivotal coupling of the cartridge engaging portion with the handle engaging portion.

27. The adapter of claim 26 wherein the resilient members are formed of an elastomeric material.

28. The adapter of claim 25 wherein the cartridge engaging portion and the handle engaging portion are hingedly coupled together.

29. The adapter of claim 25 further comprising a button movably coupled with one of the cartridge engaging portion and the handle engaging portion and operable to facilitate movement of the button assembly between the resting position and the cartridge release position wherein moving the button assembly with the button from the resting position to the cartridge release position facilitates ejection of a cartridge from the cartridge engaging portion.

30. The adapter of claim 29 further comprising a shaft coupled with the button that engages a cartridge to facilitate ejection of the cartridge from the cartridge engagement portion.

31. The adapter of claim 29 wherein the button assembly is further movable between the resting position and a handle release position wherein moving the button assembly from the resting position to the handle release position facilitates ejection of a handle from the handle engaging portion.

32. The adapter of claim 31 further comprising a shaft coupled with the button that engages a handle to facilitate ejection of the handle from the handle engagement portion.

33. A kit comprising the adapter of claim 1 in combination with a cartridge, the cartridge comprising a neck portion that comprises a tab that extends from the neck portion.

34. An adapter for coupling each of a razor handle and a razor cartridge together, the adapter comprising:

a handle engaging portion comprising:

at least one wall that defines a receptacle for receiving a razor handle;

a first handle protrusion extending from the at least one wall; and a second handle protrusion extending from the at least one wall and being spaced from the first handle protrusion;

wherein the first handle protrusion and the second handle protrusion are configured to extend into a first recess and a second recess, respectively, of a stem of a razor handle;

a cartridge engaging portion; and a pair of resilient members that facilitate pivotal coupling of the cartridge engaging portion with the handle engaging portion.

35. The adapter of claim 34 wherein the resilient members are formed of an elastomeric material.

36. The adapter of claim 34 further comprising a button assembly movably coupled with one of the cartridge engaging portion and the handle engaging portion and movable between a resting position and an ejecting position wherein moving the button assembly from the resting position to the ejecting position facilitates ejection of a cartridge from the cartridge engaging portion.

37. The adapter of claim 34 further comprising a button movably coupled with one of the cartridge engaging portion and the handle engaging portion and operable to facilitate movement of the button assembly between the resting position and the cartridge release position wherein moving the button assembly with the button from the resting position to the cartridge release position facilitates ejection of a cartridge from the cartridge engaging portion.

38. The adapter of claim 37 further comprising a shaft coupled with the button that engages a cartridge to facilitate ejection of the cartridge from the cartridge engagement portion.

39. The adapter of claim 37 wherein the button assembly is further movable between the resting position and a handle release position wherein moving the button assembly from the resting position to the handle release position facilitates ejection of a handle from the handle engaging portion.

40. The adapter of claim 37 further comprising a shaft coupled with the button that engages a handle to facilitate ejection of the handle from the handle engagement portion.

* * * * *